US009670779B2

(12) United States Patent
Heizinger et al.

(10) Patent No.: US 9,670,779 B2
(45) Date of Patent: Jun. 6, 2017

(54) BOREHOLE SUBMERSIBLE PUMP ASSEMBLY WITH A DRIVE AND A BEARING ARRANGEMENT DISPOSED AT OPPOSITE ENDS OF A SCREW PUMP

(71) Applicant: NETZSCH Pumpen & Systeme GmbH, Selb (DE)

(72) Inventors: Klaus Heizinger, Pomerode (BR); Arthur Zinke, Pomerode (BR); Eudes Borchardt, Pomerode (BR)

(73) Assignee: NETZSCH Pumpen & Systeme GmbH, Selb (DE)

( * ) Notice: Subject to any disclaimer, the term of this patent is extended or adjusted under 35 U.S.C. 154(b) by 286 days.

(21) Appl. No.: 14/503,975

(22) Filed: Oct. 1, 2014

(65) Prior Publication Data

US 2015/0093277 A1 Apr. 2, 2015

(30) Foreign Application Priority Data

Oct. 1, 2013 (DE) ..... 10 2013 110 849

(51) Int. Cl.

| | |
|---|---|
| ***F01C 1/10*** | (2006.01) |
| ***F03C 2/00*** | (2006.01) |
| ***F03C 4/00*** | (2006.01) |
| ***F04C 2/00*** | (2006.01) |
| ***F01C 21/02*** | (2006.01) |
| ***E21B 43/12*** | (2006.01) |
| ***F04C 2/107*** | (2006.01) |

(Continued)

(52) U.S. Cl.

CPC ..... *F01C 21/02* (2013.01); *E21B 43/121* (2013.01); *E21B 43/128* (2013.01); *F04C 2/103* (2013.01); *F04C 2/107* (2013.01); *F04C 2/1071* (2013.01); *F04C 13/008* (2013.01)

(58) Field of Classification Search

CPC ..... F04C 2/107; F04C 2/1071; F04C 2/1073; F04C 2/1075; F04C 2/103; F04C 13/008; F04C 2240/50; F04C 2240/52; F04C 2240/802; F01C 21/02; F01C 1/101; F01C 1/107; E21B 43/121; E21B 43/128; E21B 4/003

USPC ..... 418/48, 152–153; 166/68, 72

See application file for complete search history.

(56) References Cited

U.S. PATENT DOCUMENTS

| | | | | |
|---|---|---|---|---|
| 3,802,803 A * | 4/1974 | Bogdanov | ..... | F04C 2/1071 418/48 |
| 4,580,955 A * | 4/1986 | Karge | ..... | F04C 2/1071 418/48 |

(Continued)

FOREIGN PATENT DOCUMENTS

| | | | | |
|---|---|---|---|---|
| DE | 19848792 C1 | 5/2000 | | |
| DE | 10258666 A1 | 7/2004 | | |
| NO | WO 2009038473 A1 * | 3/2009 | ..... | F04C 2/1071 |

*Primary Examiner* — Theresa Trieu

(74) *Attorney, Agent, or Firm* — Whitmyer IP Group LLC

(57) ABSTRACT

A submersible pump assembly for use in a borehole, including a screw pump and/or an eccentric screw pump with a longitudinal axis. The submersible assembly further includes a drive and a bearing arrangement for taking up and diverting the axial and/or radial forces arising during the operation of the screw pump and/or eccentric screw pump. The drive is disposed, via a first coupling rod, at one end of the screw pump and/or eccentric screw pump and the bearing arrangement is assigned, via a second coupling rod, to the opposite end of the screw pump and/or eccentric screw pump along the longitudinal axis.

11 Claims, 2 Drawing Sheets

(51) Int. Cl.
*F04C 13/00* (2006.01)
*F04C 2/10* (2006.01)

(56) References Cited

U.S. PATENT DOCUMENTS

| | | | | |
|---|---|---|---|---|
| 5,209,294 | A * | 5/1993 | Weber | E21B 43/121 166/105 |
| 6,357,552 | B1 * | 3/2002 | Eitler | E21B 43/121 166/68 |
| 8,132,618 | B2 * | 3/2012 | Blaquiere | E21B 43/126 166/377 |
| 2010/0239446 | A1 * | 9/2010 | Ree | F04C 2/1071 418/48 |

* cited by examiner

BOREHOLE SUBMERSIBLE PUMP ASSEMBLY WITH A DRIVE AND A BEARING ARRANGEMENT DISPOSED AT OPPOSITE ENDS OF A SCREW PUMP

FIELD OF THE INVENTION

The present invention relates to a submersible pump assembly for use in a borehole to deliver fluid extracted from an underground source.

BACKGROUND OF THE INVENTION

Submersible pumps for use in a borehole are known from the prior art, for example as NSPCP (Netzsch submersible PCP=submersible eccentric screw pump from Netzsch) or ESPCP (=electrical submersible eccentric screw pump). In these submersible pumps, a submersible motor present at the lower end is provided, which by means of a coupling rod drives an eccentric screw pump located above. Compared with the conventionally used centripetal pumps, the use of eccentric screw pumps has the advantage that products with higher viscosity, for example with higher sand and paraffin components, can be delivered.

In order to be able to take up the axial force resulting from the delivery pressure, a bearing arrangement for bearing the coupling rod is usually disposed directly above the submersible motor or above a gear unit connected to the submersible motor.

DE 10258666 A1 describes a submersible pump arrangement for use in a borehole with a screw or eccentric screw pump, wherein a coupling part taking up axial and radial forces is disposed between the slowly rotating drive and the screw or eccentric screw pump.

DE 19848792 C1 describes a submersible pump arrangement for use in a borehole, which comprises a gear unit and a compensator between the drive and the eccentric screw pump. A gear stage serves to slow down the rotary motion of the input shaft in the gear housing. The compensator brings the lubricating fluid pressure in the gear housing into line with the ambient pressure. In order to distribute the arising heat of the gear stage uniformly over the lubricating fluid, the compensator is disposed inside the gear housing beside the gear stage and is integrated into the lubricating fluid circuit.

An essential drawback with these arrangements consists in the fact that slender and rapidly running coupling rods between the drive and the screw or eccentric screw pump have a tendency to buckle easily on account of the prevailing axial force and then run against the housing pipe. This leads to friction between the coupling rod and the housing pipe and therefore to wear of these components, which accordingly often have to be exchanged or replaced.

The problem of the invention consists in overcoming the drawbacks of the prior art, in particular the buckling of the coupling rods due to axial forces acting on the coupling rods is to be prevented.

The above problem is solved by a submersible pump assembly which comprises the features described in the independent claim. Further advantageous embodiments are described in the sub-claims.

SUMMARY OF THE INVENTION

The invention relates to a submersible pump assembly for use in a borehole. In particular, borehole is understood to mean a bore into the earth for the delivery of crude oil and natural gas. In particular, the submersible pump assembly comprises a screw pump and/or an eccentric screw pump with a longitudinal axis for the delivery of medium inside an ascending pipe disposed in the borehole in an upwardly directed delivery direction, i.e. in a delivery direction directed towards the Earth's surface. The screw pump and/or eccentric screw pump is preferably driven by a drive, in particular a motor. The submersible pump assembly also comprises a bearing arrangement. The bearing arrangement serves to take up and divert the axial and/or radial forces arising during the operation of the screw pump and/or eccentric screw pump.

According to the invention, the drive is disposed, via a first coupling rod, at one end of the screw pump and/or eccentric screw pump along the longitudinal axis. The bearing arrangement is assigned, via a second coupling rod, to the opposite end of the screw pump and/or eccentric screw pump along the longitudinal axis. In particular, the bearing arrangement is thus assigned to the end of the rotor of the screw pump and/or eccentric screw pump that faces away from the drive.

In an arrangement of the submersible pump assembly in the borehole, the drive is preferably disposed beneath the screw pump and/or eccentric screw pump. In particular, there is disposed between the drive and the rotor of the screw pump and/or eccentric screw pump a first coupling rod which transmits the drive energy to the rotor. The bearing arrangement of the submersible pump assembly is disposed inside the borehole above the screw pump and/or eccentric screw pump.

According to an embodiment of the invention, an adjusted support bearing in an O-shape is used as a bearing arrangement. The latter can take up axial forces and also radial forces and divert the latter into the surrounding structure, wherein the function of taking up axial and radial forces is divided between an axial bearing and a radial bearing. In the adjusted support bearing, the two bearings are clamped against one another and there is only a slight tilting play.

According to an embodiment of the invention, the bearing arrangement is a component of a bearing unit. The screw pump and/or eccentric screw pump comprises a rotor and a stator, wherein a first coupling rod for transmitting the drive energy of the drive to the rotor is disposed between the drive disposed below in the borehole and the rotor of the screw pump and/or eccentric screw pump disposed above the latter. Furthermore, a second coupling rod is disposed between the end of the rotor facing away from the drive and the bearing unit.

The bearing unit is preferably connected via a fastening device to the second coupling rod and/or to a housing pipe surrounding the second coupling rod. Furthermore, the bearing unit can comprise, in the region between the fastening device and the bearing arrangement, a slip-ring seal for sealing the interior of the bearing unit. In particular, the slip-ring seal seals the bearing interior at the lower end of the bearing unit hermetically with respect to the delivered medium.

According to an embodiment of the invention, delivered medium flows around the bearing unit in the borehole, as a result of which heat of the bearing arrangement is carried away.

The bearing unit can also comprise a pressure compensation piston for compensating for the differential pressure between a lubricant of the bearing arrangement and the delivered medium. The pressure compensation piston prevents the oil-lubricated bearing unit from being soiled with contaminated delivery medium, in that it compensates for the differential pressure between the lubricating oil of the bearing unit and the delivered medium.

In the submersible pump assembly according to the invention, the axial and/or radial forces of the screw pump and/or eccentric screw pump are converted by the bearing unit into a tensile force. Instead of supporting the axial force as a compressive force on a bearing arrangement located beneath the eccentric screw pump, between the eccentric screw pump and the submersible motor, as is known conventionally, said axial force is taken up, in the submersible pump assembly according to the invention, as a tensile force on a bearing arrangement of the bearing unit located above the screw pump and/or eccentric screw pump and in the delivery flow. The bearing unit thus serves in particular to protect the coupling rods, since the latter are relieved of the buckling force.

BRIEF DESCRIPTION OF THE DRAWINGS

Examples of embodiment of the invention and its advantages will be explained in greater detail below with the aid of the appended figures. The size ratios of the individual elements with respect to one another in the figures do not always correspond to the actual size ratios, since some forms are represented simplified and other forms enlarged in relation to other elements for the sake of better clarity.

DETAILED DESCRIPTION OF THE INVENTION

Identical reference numbers are used for identical or identically acting elements of the invention. Furthermore, for the sake of clarity, only reference numbers that are required for the description of the given figure are represented in the individual figures. The represented embodiments merely represent examples as to how the device according to the invention can be embodied and do not represent a definitive limitation.

Figure 1:
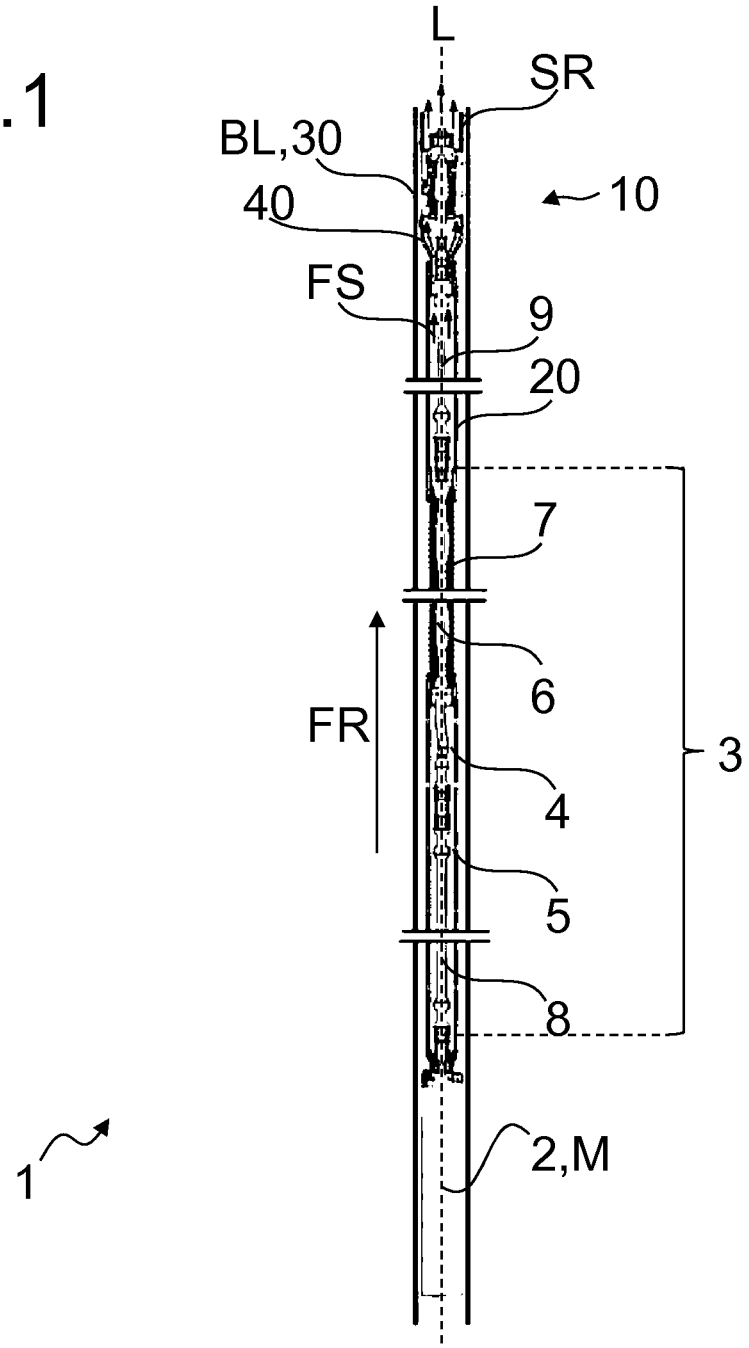
FIG. 1 shows a submersible pump assembly according to the invention with a bearing unit for use in a borehole.

FIG. 1 shows a submersible pump assembly 1 with a bearing unit 10 for use in a borehole BL. A lining 30 is often provided in borehole BL, said lining stabilising borehole BL. Submersible pump assembly 1 comprises an eccentric screw pump 3 with a longitudinal axis L, a drive 2, for example a motor M for driving eccentric screw pump 3, and a bearing arrangement 12 for taking up and diverting the axial and/or radial forces occurring during the operation of eccentric screw pump 3.

Submersible pump assembly 1 is disposed in borehole BL in particular in such a way that drive 2 forms the lower end of submersible pump assembly 1. Disposed above a submersible pump assembly 1 is an ascending pipe SR, in which liquid flow FS of the delivered medium rises upwards in delivery direction FR.

Eccentric screw pump 3 comprises a pump housing 4 with suction openings 5 for the medium to be delivered in delivery direction FR. Furthermore, eccentric screw pump 3 comprises a stator 7 and a rotor 6. Rotor 6 is connected to external drive 2 via a directly driven coupling rod 8 disposed in pump housing 4. The opposite end of rotor 6 is connected to bearing unit 10 via a further coupling rod 9, which is surrounded by a housing pipe 20. In particular, bearing unit 10 thus forms, inside borehole BL, the upper end of submersible pump assembly 1 and borders directly on ascending pipe SR.

Liquid flow FS of the delivered medium washes around upper coupling rod 9 inside housing pipe 20. Disposed at the upper end of coupling rod 9, which lies opposite rotor 6, is bearing unit 10, which is represented in detail in FIG. 2. In particular, a fastening device 40 is provided, which connects housing pipe 20 to bearing unit 10.

Figure 2:
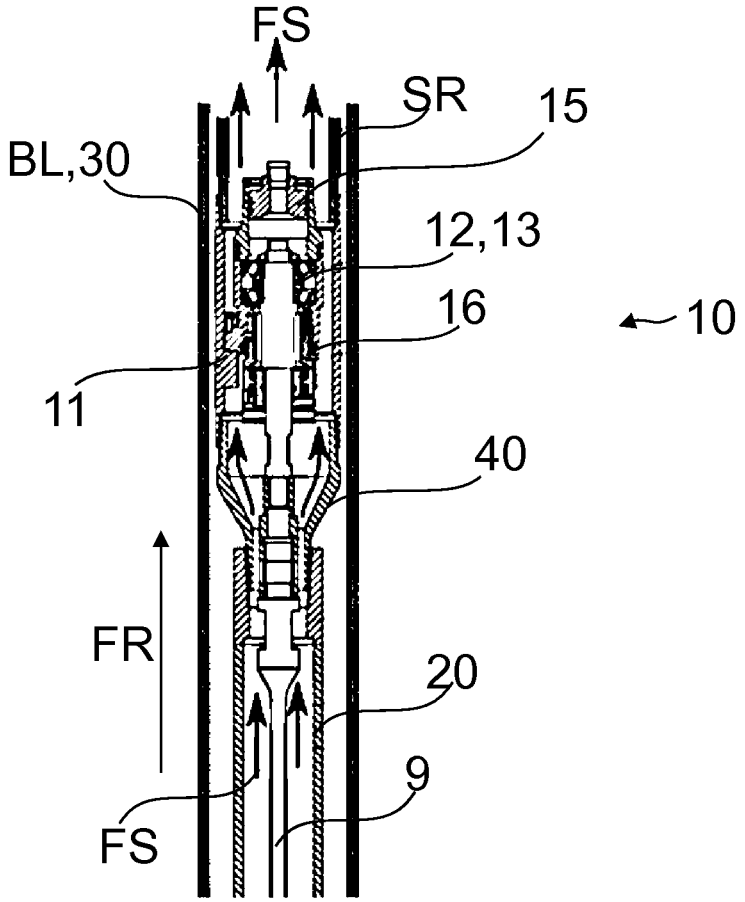
FIG. 2 shows a bearing unit of a submersible pump assembly according to FIG. 1.

FIG. 2 shows a bearing unit 10 of a submersible pump assembly 1 according to FIG. 1. Bearing unit 10 serves in particular for the guidance of upper coupling rod 9 and for passing the axial forces occurring during operation of eccentric screw pump 3 (compare FIG. 1) into the surrounding structure. Bearing unit 10 comprises a bearing housing 11 with a bearing arrangement 12 disposed therein. Bearing arrangement 12 provides a coupling which takes up the axial and radial forces and which is required for the reliable operation of eccentric screw pump 3.

It can for example be a so-called fixed bearing, which can take up both axial and radial forces and divert them into the surrounding structure, in particular into bearing housing 11. Alternatively, a so-called separate bearing arrangement can be used, wherein the function of taking up axial and radial forces is divided between an axial bearing and a radial bearing. In the example of embodiment shown, a so-called adjusted support bearing 13 is used as bearing arrangement 12. The adjustment of axial bearing and radial bearing is understood to mean a defined clamping of the two bearings against one another. In the represented O-arrangement, bearing arrangement 12, 13 can take up a greater tilting moment than in an X-arrangement (not represented), since the spacing of the centres of pressure is greater in the O-arrangement.

The upper free end of bearing unit 10 is disposed and fastened at the lower end of an ascending pipe SR. A pressure compensation piston 15 is provided between bearing arrangement 12 and ascending pipe SR. The differential pressure between the lubricating oil of bearing arrangement 12 and the delivered medium is compensated for with pressure compensation piston 15. This thus effectively prevents oil-lubricated bearing unit 10 from being soiled by contaminated delivery medium.

A slip-ring seal 16 is disposed on the shaft input, i.e. adjacent to the upper end of coupling rod 9 and to the lower end or in the lower region of bearing unit 10. Slip-ring seal 16 seals the interior of bearing unit 10 hermetically with respect to delivery flow FS of the delivered medium. Delivery medium flows around bearing unit 10, as a result of which the heat of bearing arrangement 12 of bearing unit 10 is carried away.

Instead of supporting the axial force, as conventionally known, as a compressive force on a bearing arrangement located beneath eccentric screw pump 3, between eccentric screw pump 3 and submersible motor M, the axial force is taken up as a tensile force on a bearing unit 10 located above eccentric screw pump 3 and in liquid flow FS and thus relieves coupling rods 8, 9 lying beneath of the buckling force.

The invention has been described by reference to a preferred embodiment. The person skilled in the art can however envisage that modifications or changes to the invention can be made without thereby departing from the scope of protection of the following claims.

LIST OF REFERENCE NUMBERS

1 Submersible pump assembly
2 Drive

3 Eccentric screw pump
4 Pump housing
5 Suction opening
6 Rotor
7 Stator
8 Coupling rod
9 Coupling rod
10 Bearing unit
11 Bearing housing
12 Bearing arrangement
13 Adjusted support bearing
15 Pressure compensation piston
16 Slip-ring seal
20 Housing pipe
30 Lining
40 Fastening device
BL Borehole
FR Delivery direction
FS Delivery flow
L Longitudinal axis
M Motor
SR Ascending pipe

What is claimed is:

1. A submersible pump assembly for use in a borehole, comprising:

a screw pump with a longitudinal axis;

a drive; and a bearing arrangement configured to take up and divert at least one of (i) axial forces occurring during operation of the screw pump and (ii) radial forces occurring during operation of the screw pump;

wherein the drive is disposed, via a first coupling rod, at one end of the screw pump along the longitudinal axis and that the bearing arrangement is assigned, via a second coupling rod, to the opposite end of the screw pump along the longitudinal axis.

2. The submersible pump assembly according to claim 1, wherein the submersible pump assembly is disposed in the borehole in such a way that the drive is disposed in the borehole beneath the screw pump and that the bearing arrangement of the submersible pump assembly is disposed inside the borehole above the screw pump.

3. The submersible pump assembly according to claim 1, wherein the bearing arrangement is an adjusted support bearing in an 0-shape.

4. The submersible pump assembly according to claim 1, wherein the bearing arrangement is a component of a bearing unit.

5. The submersible pump assembly according to claim 4, wherein the screw pump comprises a rotor and a stator, wherein the first coupling rod is configured to transmit drive energy of the drive to the rotor and is disposed between the drive and the rotor of the screw pump; and wherein the second coupling rod is disposed between the end of the rotor of the screw pump facing away from the drive and the bearing unit.

6. The submersible pump assembly according to claim 5, wherein the bearing unit is connected via a fastening device to at least one of (i) the second coupling rod and (ii) a housing pipe surrounding the second coupling rod.

7. The submersible pump assembly according to claim 6, wherein the bearing unit comprises, in a region between the fastening device and the bearing arrangement, a slip-ring seal configured to seal an interior of the bearing unit.

8. The submersible pump assembly according to claim 4, wherein delivered medium flows around the bearing unit in the borehole in a manner that carries away heat of the bearing arrangement.

9. The submersible pump assembly according to claim 4, wherein the bearing unit comprises a pressure compensation piston configured to compensate for differential pressure between a lubricant of the bearing arrangement and a delivered medium.

10. The submersible pump assembly according to claim 4, wherein axial force of the screw pump is convertible into a tensile force by the bearing arrangement of the bearing unit.

11. The submersible pump assembly according to claim 1, wherein the screw pump is an eccentric screw pump.

* * * * *